US009457931B2

(12) United States Patent
Hou et al.

(10) Patent No.: US 9,457,931 B2
(45) Date of Patent: Oct. 4, 2016

(54) PACKING STRUCTURE INCLUDING A LARGE CARTON AND SMALLER CARTONS CONTAINED THEREIN

(71) Applicants: Panasonic Ecology Systems Guangdong Co., Ltd., Foshan, Guangdong (CN); Panasonic Corporation, Osaka (JP)

(72) Inventors: Guancheng Hou, Guangdong (CN); Bodong Zhong, Guangdong (CN); Shouyong Gao, Guangdong (CN); Daisuke Tsubosa, Aichi (JP)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 0 days.

(21) Appl. No.: 14/563,157

(22) Filed: Dec. 8, 2014

(65) Prior Publication Data

US 2015/0158630 A1 Jun. 11, 2015

(30) Foreign Application Priority Data

Dec. 9, 2013 (CN) ..... 2013 2 0807555 U

(51) Int. Cl.
*B65D 21/02* (2006.01)

(52) U.S. Cl.
CPC ... *B65D 21/0237* (2013.01); *B65D 2585/6807* (2013.01)

(58) Field of Classification Search
CPC B65D 5/5019; B65D 5/5059; B65D 5/5286; B65D 21/0237; B65D 2577/041; B65D 2577/042; B65D 27/043; B65D 2585/6807
USPC ..... 206/320, 486–490, 731, 733, 734; 220/23.87, 23.88, 23.89; 229/122
See application file for complete search history.

(56) References Cited

U.S. PATENT DOCUMENTS

| | | | | | |
|---|---|---|---|---|---|
| 1,198,792 | A * | 9/1916 | Tracy | B65D 85/324 | 206/521 |
| 1,631,080 | A * | 5/1927 | Baker | B65D 5/5038 | 229/120.01 |
| 1,667,887 | A * | 5/1928 | Fallert | B65D 5/5035 | 206/320 |
| 3,414,121 | A * | 12/1968 | Suzuki | B65D 81/113 | 206/320 |
| 3,908,827 | A * | 9/1975 | Bemmels | B65D 73/005 | 206/488 |

(Continued)

FOREIGN PATENT DOCUMENTS

| | | | | |
|---|---|---|---|---|
| CH | EP 1407972 A1 * | 4/2004 | ..... | B65D 5/5286 |
| DE | 3513351 A1 * | 10/1986 | ..... | B65D 5/5286 |

(Continued)

*Primary Examiner* — Bryon Gehman
(74) *Attorney, Agent, or Firm* — RatnerPrestia

(57) ABSTRACT

A packing structure including an external packing carton consisting of a top surface, a bottom surface and side surfaces connected with one another and one or more small packing cartons, wherein at least one side surface of the external packing carton is provided with one or more folding portions, each folding portion consisting of one or more folding pieces which are folded to form an opening with a size mating with the size of the periphery of the small packing carton. The packing structure of the present disclosure is easy to be transported, cost reducing and friendly to the environment.

15 Claims, 6 Drawing Sheets

(56) References Cited

U.S. PATENT DOCUMENTS 3,937,322 A * 2/1976 Cohen ..... B01L 9/543 206/486
4,350,249 A * 9/1982 Caston ..... B65D 25/10 206/486
4,640,419 A * 2/1987 Yang ..... B65D 71/00 206/320
4,957,202 A * 9/1990 Yoshiki ..... B65D 21/0237 206/734
5,197,606 A * 3/1993 Lancaster ..... B65D 5/5052 206/486
5,779,045 A * 7/1998 Yu ..... B65D 85/68 206/320
6,769,543 B2 * 8/2004 Hsu ..... B65D 5/5038 206/486
6,968,953 B2 * 11/2005 Humphrey ..... B65D 85/68 206/320
8,820,620 B2 * 9/2014 Vincent ..... B65D 5/0254 220/23.89

FOREIGN PATENT DOCUMENTS

FR 2239393 A * 2/1975
GB 524291 A * 8/1940 ..... B65D 5/5286

* cited by examiner

PACKING STRUCTURE INCLUDING A LARGE CARTON AND SMALLER CARTONS CONTAINED THEREIN

CROSS-REFERENCE TO RELATED APPLICATION

This application claims the benefit of Chinese Patent Application No. 201320807555.8 filed on Dec. 9, 2013 in the State Intellectual Property Office of China, the whole disclosure of which is incorporated herein by reference.

BACKGROUND OF THE INVENTION

1. Field of the Invention

The present invention relates to a packing structure.

2. Description of the Related Art

Packing cartons are commonly used to packing various articles. FIG. 1 is a schematic view of a packing carton in the prior art. The packing carton in FIG. 1 is shown to pack a ventilating fan as an example.

Ventilating fans are commonly-used apparatuses mounted between a ceiling and a roof for ventilating. There is a kind of ventilating fan in the art, by which a customer can choose to buy only a ventilating fan machine or to buy a ventilating fan machine together with one or more functional units freely mountable to the ventilating fan machine. The ventilating fan can have more functions by mounting the functional units to it. The functional units include humidity sensor, a carbon monoxide (CO) sensor, a human body sensor, a night light and an air flow adjustment button and the like.

When a customer just buys a ventilating fan machine, the distributor only needs to use an externally packing carton for packing the ventilating fan machine. However, when a customer buys a ventilating fan machine and a functional unit, the distributor needs to use a plurality of additional small cartons 2 for packing the individual functional units respectively and an additional large carton 1 for packing the plurality of small cartons together for the convenience of transportation. Since a large number of cartons need to be transported, man hours are increased; both the large cartons and the small carton are used, the cost is increased; further, the large cartons 1 and the small cartons 2 are discarded after use, which will cause environmental damage.

SUMMARY OF THE INVENTION

The present invention has been made to overcome or alleviate at least one aspect of the above mentioned disadvantages.

Accordingly, it is an object of the present invention to provide a packing structure, which is convenient for transportation and friendly to the environment, and results in reduced cost.

To achieve the above object, the present invention provides a packing structure, comprising: an external packing carton consisting of a top surface, a bottom surface and side surfaces connected with one another and one or more small packing cartons, wherein at least one side surface of the external packing carton is provided with one or more folding portions, each folding portion consisting of one or more folding pieces which are folded to form an opening with a size mating with the size of the periphery of the small packing carton.

In an embodiment of the present invention, the size of the external packing carton corresponds to the size of a ventilating fan machine; and the size of each of the small packing carton corresponds to the size of a functional unit freely mountable to the ventilating fan machine.

In an alternative embodiment of the present invention, there are two or more small packing cartons with the same size or different sizes.

In an alternative embodiment of the present invention, the folding pieces are folded inward to the inside of the external packing carton so as to form the opening.

In an alternative embodiment of the present invention, the folding pieces include an upper piece, a lower piece, a left piece and a right piece combined with one another to form a rectangular shape.

In an alternative embodiment of the present invention, the upper piece, the lower piece, the left piece and the right piece each are rectangular; the left and right sides of each of the upper piece and the lower piece are completely cut off or are formed as scores.

In an alternative embodiment of the present invention, the lower side of the upper piece and the upper side of the lower piece are completely cut off or formed as scores; the intermediate side between the left piece and the right piece is completely cut off or formed as a score.

In an alternative embodiment of the present invention, the upper piece, the lower piece, the left piece and the right piece are each triangular; two of the sides, which are positioned between two adjacent triangular pieces, of each of the upper piece, the lower piece, the left piece and the right piece are completely cut off or formed as scores.

In an alternative embodiment of the present invention, a plurality of sides of the folding piece, except one side thereof that is connected with the external packing carton, are completely cut off or formed as scores.

In an alternative embodiment of the present invention, after the small packing carton packed with the functional unit is put into the opening, adhesive tapes are connected to the edges of the opening on the outer side of the external packing carton.

In an alternative embodiment of the present invention, buffering material is provided between the external packing carton and the packed article; the thickness of the buffering material between the packed article and the side surface of the external packing carton provided with the folding portion is equal to the thickness of the small packing carton from a side on an inner side of the external packing carton to a side on an outer side of the external packing carton.

In an alternative embodiment of the present invention, the folding piece is provided with a stopping part on a side thereof opposite to a side surface of the external packing carton provided with the folding piece.

In an alternative embodiment of the present invention, the top surface and the bottom surface of the external packing carton each are provided with inner folding wings and outer folding wings, and the folding portion is provided on a side surface of the external packing carton not in the way for opening the inner folding wings and the outer folding wings.

The packing structure according to the embodiments of the present invention is advantageous in that it is convenient for transportation, cost reducing and friendly to the environment.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
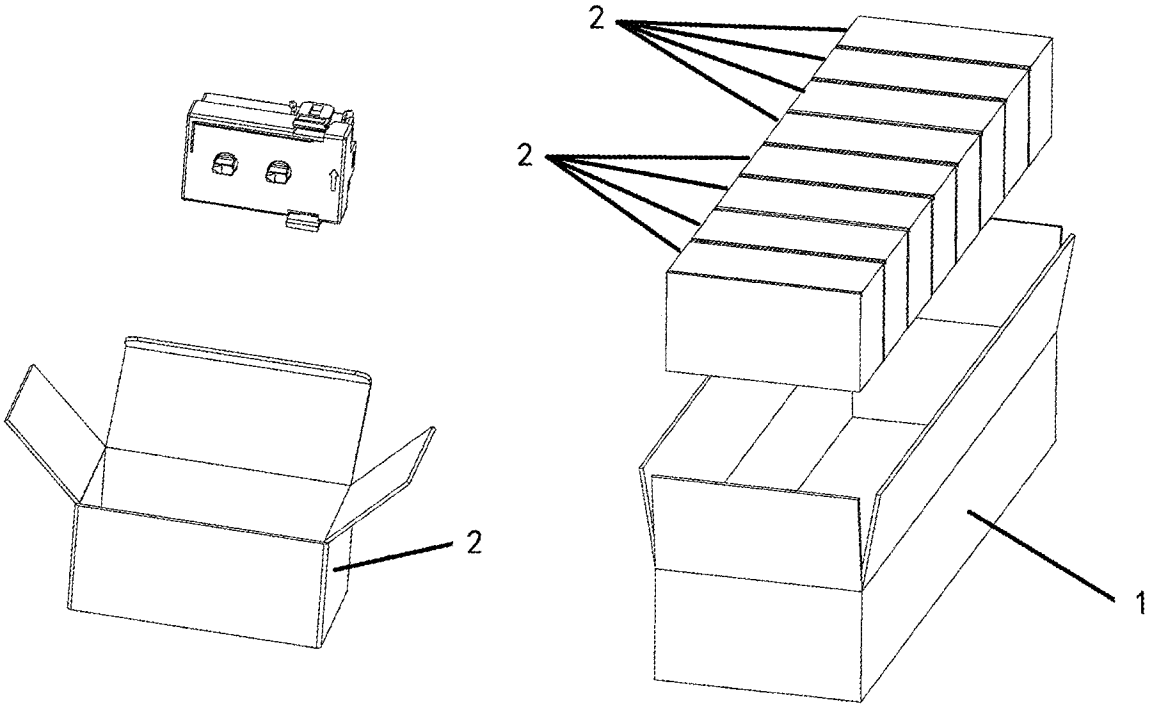
Fig. 1 PRIOR ART
FIG. 1 is a schematic view of a packing structure in the prior art.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
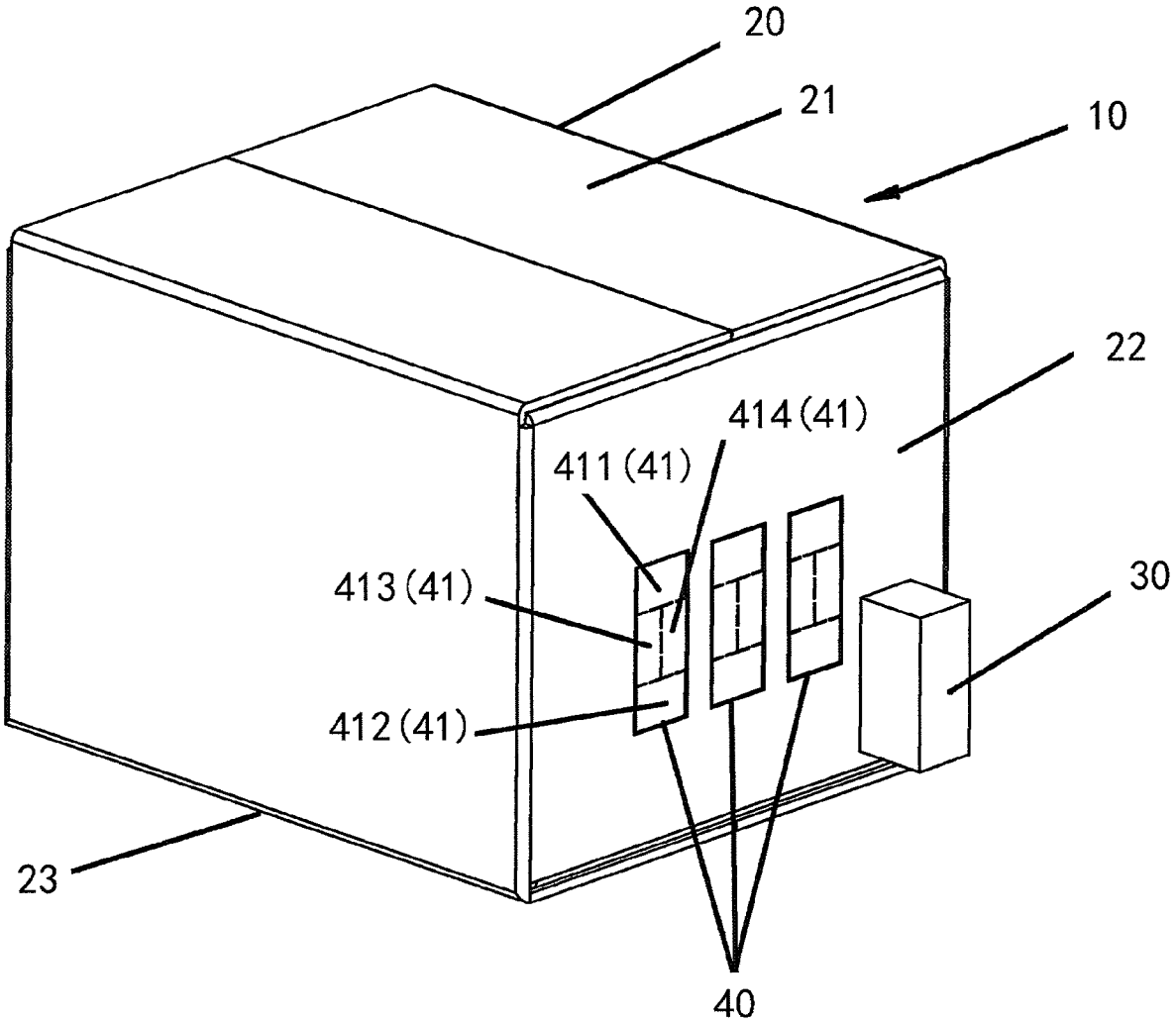
FIG. 2 is a schematic view of a packing structure according to a first embodiment of the present invention, in which a folding portion does not form an opening.
Figure 3:
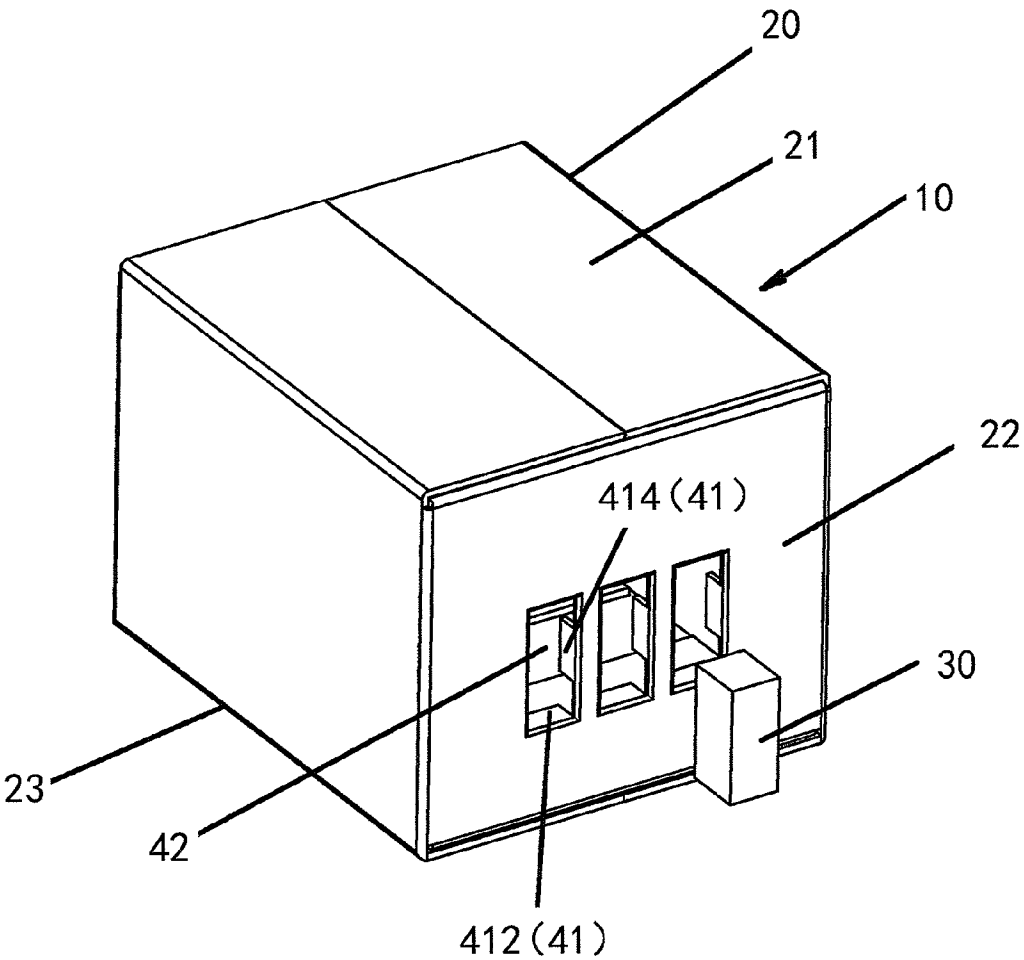
FIG. 3 is a schematic view of a packing structure according to the first embodiment of the present invention, in which the folding portion forms an opening.
Figure 4:
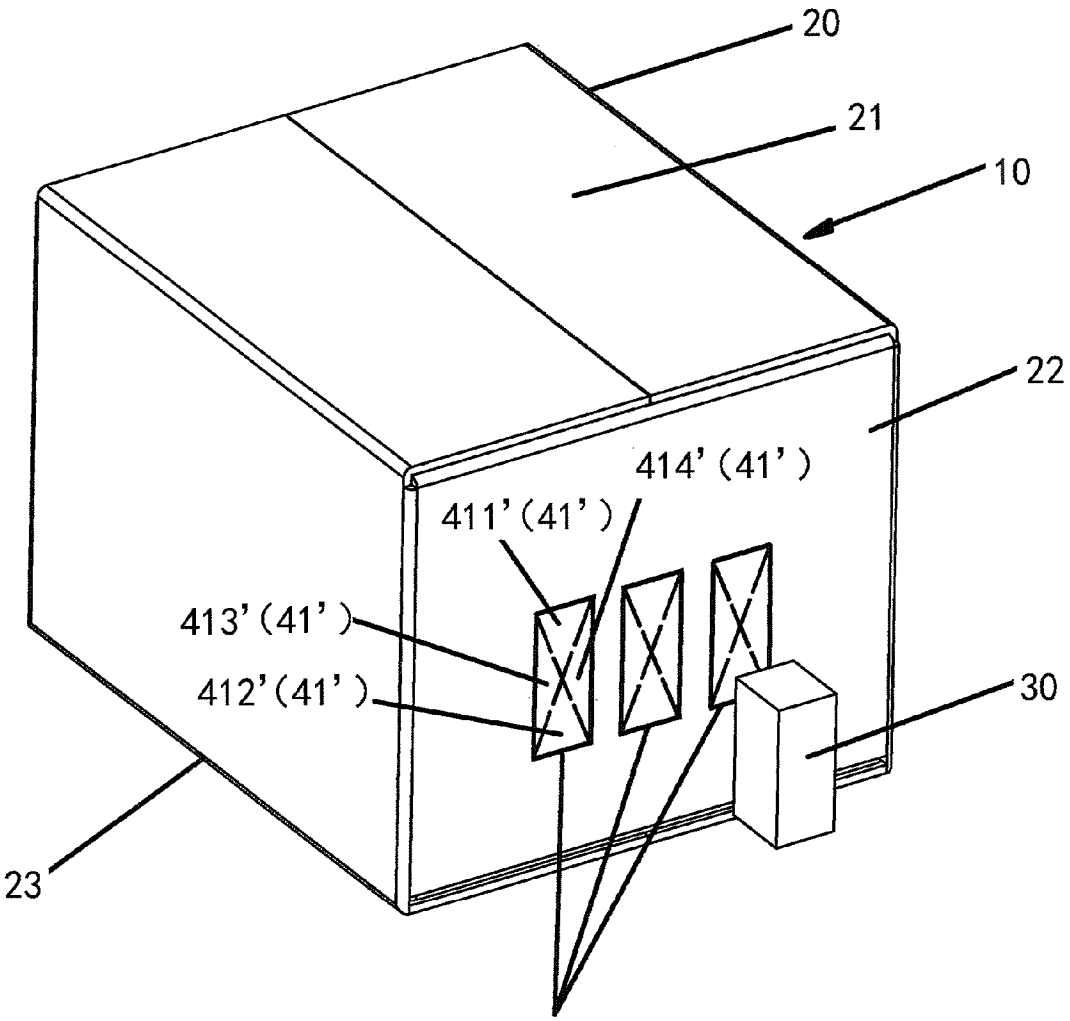
FIG. 4 is a schematic view of a packing structure according to a second embodiment of the present invention, in which a folding portion does not form an opening.

FIG. 2 is a schematic view of a packing structure according to a first embodiment of the present invention, in which a folding portion does not form an opening. FIG. 3 is a schematic view of a packing structure according to the first embodiment of the present invention, in which the folding portion forms an opening. FIG. 4 is a schematic view of a packing structure according to a second embodiment of the present invention, in which a folding portion does not form an opening. As shown in the figures, a packing structure 10 comprises an external packing carton 20 consisting of a top surface 21, side surfaces 22, and a bottom surface 23 connected with one another and one or more small packing cartons 30. At least one side surface 22 of the external packing carton 20 is provided with one or more folding portions 40, each folding portion 40 consisting of one or more folding pieces 41 which are folded to form an opening 42 with a size mating with the size of the periphery of the small packing carton 30.

Figure 5:
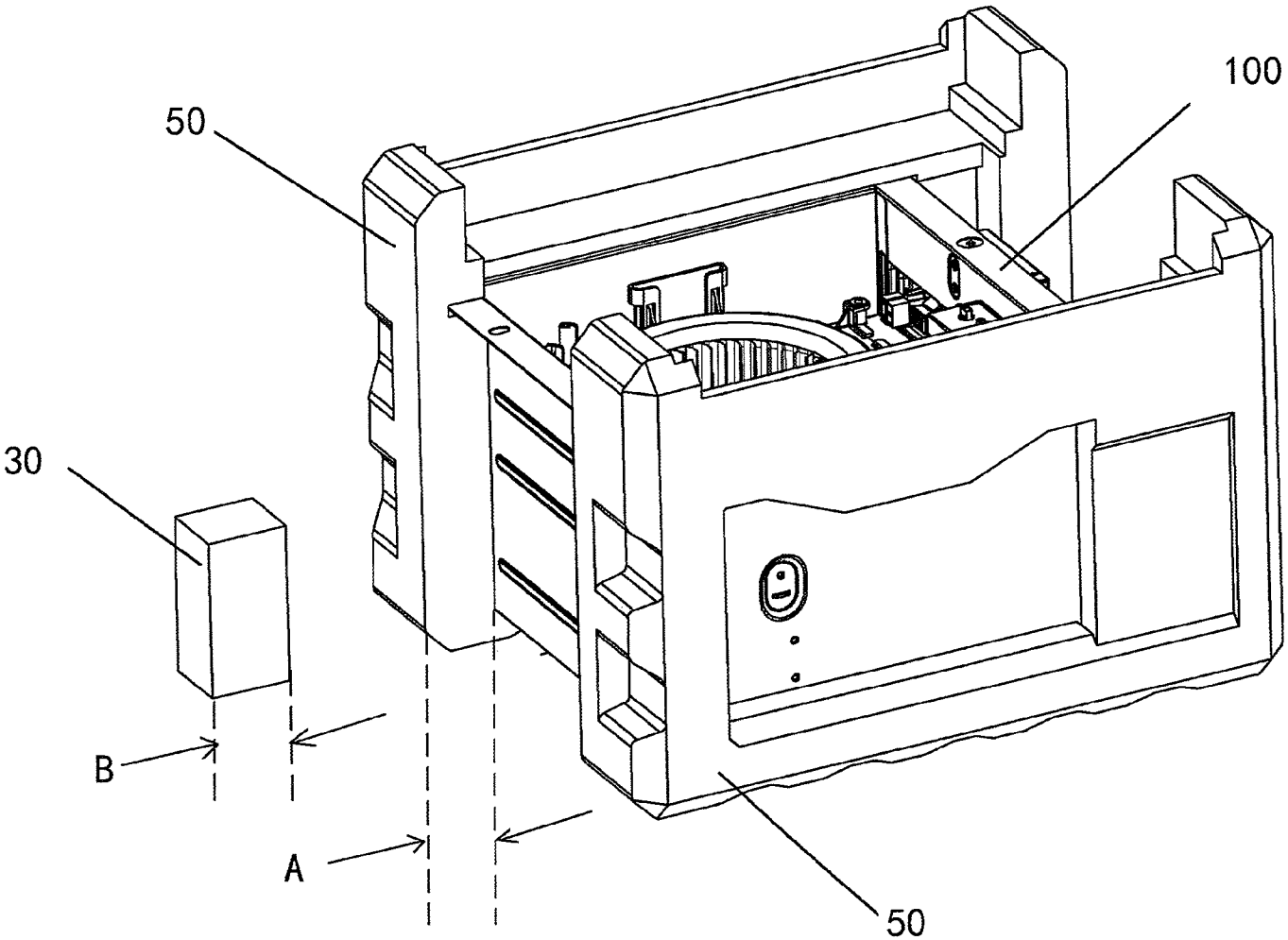
FIG. 5 is a schematic view showing the cooperation between the buffering material and the small packing carton according to an embodiment of the present invention.

In this embodiment, a ventilating fan is taken as an example of an article to be packed. The external packing carton 20 is sized according to the size of a ventilating fan machine so as to accommodate the ventilating fan machine 100 (as shown in FIG. 5). If there are two or more functional units of the same size or different sizes to be freely mountable to the ventilating fan machine 100, the small packing cartons 30 corresponding to the respective functional units may have the same size or different sizes. So long as the external packing carton 20 can suitably pack the ventilating fan machine 100, and the respective small packing cartons 30 can suitably pack the respective functional units (not shown in the figures), the sizes of the external packing carton 20 and the respective small packing cartons are not limited.

Each of the upper surface 21 and the lower surface 23 of a commercial external packing carton 20 for packing the ventilating fan machine 100 typically consists of inner folding wings (not shown) and outer folding wings 102, which can be opened or closed. The folding portions 40 can be disposed on a side surface 22 of the external packing carton 20 which is not in the way for opening the inner folding wings and the outer folding wings 102 so as not to interfere with the opening and closing of the upper surface 21 and the lower surface 23.

The folding portion 40 can be provided on any one of the side surfaces 22 of the external packing carton 20. The folding portion 40 consists of one or more folding pieces 41 (41'), which are folded inward to the inside of the external packing carton 20 to form an opening 42. When a customer just buys the ventilating fan machine 100 without any functional unit, it is not necessary to fold the folding pieces 41 (41') of the folding portion 40 and thus there will be no opening formed in the side surface 22 of the external packing carton 20. Therefore, the ventilating fan machine 100 can be packed in the external packing carton 20 in the same way as in the prior art.

On the other hand, if a customer buys the ventilating fan machine 100 together with functional units, the distributor can fold the folding pieces 41 (41') of the folding portions 40 so that the side surfaces 22 of the external packing carton 20 form openings 42 of the same number as the number of the functional units, and the sizes of the respective openings 42 correspond to the sizes of the respective functional units. Then the small packing cartons 30 for packing the functional units can be inserted into the respective openings 42. Since the folding pieces 41 (41') can be folded and the sizes of the openings 42 correspond to the sizes of the peripheries of the small packing carton 30 for packing the individual functional units, respectively, that is, the sizes of the openings 42 correspond to the lateral sectional area or the longitudinal sectional area of the small packing cartons 30, the small packing cartons 30 can fully block the openings 42 after being put into the openings 42 so that there are no gaps existing in the side surfaces 22 of the external packing carton 20 and foreign matters will not enter the external packing carton 20 from the gaps during transportation.

With the above configuration, when a customer buys a functional unit, the distributor can put a small packing carton 30 for packing the functional unit into the opening 42 provided in a side surface 22 of the external packing carton 20 to be transported conveniently; when a customer buys a plural functional units, the distributor does not need to put the small packing cartons 30 for packing a plural functional units into one additional large carton; instead, the distributor can put the small packing cartons 30 for packing the respective functional units into the openings 42 provided in the side surfaces 22 of the external packing carton 20 so that they can be transported conveniently and the cost can be reduced.

The folding pieces 41 (41') are folded inward to the inside of the external packing carton 20 to form the opening 42. Since the folding pieces 41 (41') are folded inward to the inside of the external packing carton 20, they will not project out of the external packing carton 20.

The folding pieces 41 (41') include an upper piece 411 (411'), a lower piece 412 (412'), a left piece 413 (413') and a right piece 414 (414') combined with one another to form a rectangular shape. With the above configuration, when the upper piece 411 (411'), the lower piece 412 (412'), the left piece 413 (413') and the right piece 414 (414') are folded inward to the inside of the external packing carton 20, an opening 42 capable of surrounding the periphery of the small packing carton 30 for packing the functional unit can be formed to position and hold the small packing carton 30.

Referring to FIGS. 2 and 3, in the first embodiment, the upper piece 411, the lower piece 412, the left piece 413 and the right piece 414 each are rectangular; the left and right sides of each of the upper piece 411 and the lower piece 412 are completely cut off; the lower side of the upper piece 411 and the upper side of the lower piece 412 are formed as scores; and the intermediate side between the left piece 413 and the right piece 414 is formed as a score. With the above configuration, the distributor can cut off the scores easily by hand, and then fold the respective folding pieces 41 inward to the inside of the external packing carton 20 so as to open the opening 42 in the side surface 22 of the external packing carton 20. Since the opening 42 is easy to be opened and the small packing carton 30 can be easily inserted, the packing can be easily conducted.

Alternatively, the left and right sides of each of the upper piece 411 and the lower piece 412 can be formed as scores instead of being cut off completely, and the lower side of the upper piece 411 and the upper side of the lower piece 412 can be cut off completely instead of being formed as scores; and the intermediate side between the left piece 413 and the right piece 414 can be cut off completely instead of being formed as a score. Alternatively, the folding piece 41 can be formed so that one side thereof keeps fully connected with the side surface 22 of the external packing carton 20, and the remaining sides thereof except the one side are formed as scores or completely cut off. A person skilled in the art can choose to cut off the sides completely or form the sides as scores according to actual needs.

As shown in FIG. 4, according to a second embodiment, the folding pieces 41' include an upper piece 411', a lower piece 412', a left piece 413' and a right piece 414' combined with one another to form a rectangular shape. Unlike the first embodiment, the upper piece 411', the lower piece 412', the left piece 413' and the right piece 414' each are triangular, and two sides of each of the upper piece 411', the lower piece 412', the left piece 413' and the right piece 414', which are positioned between two adjacent triangular pieces, are completely cut off or formed as scores. A person skilled in the art can choose to cut off the sides completely or form the sides as scores according to actual needs. Like the first embodiment, the distributor can easily cut off the scores by hand and fold the respective folding pieces 41' inward to the inside of the external packing carton 20 so as to open the opening 42 formed in the side surface 22 of the external packing carton 20.

When the small packing carton 30 packed with the functional unit is put into the opening 42, adhesive tapes can be adhered to the external packing carton 20 on the outside of the opening 42 to cover the opening 42. Therefore, the small packing carton 30 for packing the functional unit can be prevented from dropping off the opening 42 and it is easy for transportation.

FIG. 5 is a schematic view showing the cooperation between the buffering material and the small packing carton according to an embodiment of the present invention. As shown in FIG. 5, a buffering material 50 is provided between the external packing carton 20 and the ventilating fan machine 100. The thickness of the buffering material 50 between the ventilating fan machine 100 and the side 22 provided with the folding portion 40 is equal to the thickness of the small packing carton 30 from a side thereof on an inner side of the external packing carton 20 to a side thereof on an outer side of the external packing carton 20.

The buffering material 50 comprises foam plastics, corrugated board, air cushion bag and other material commonly used to buffer external force and protect the ventilating fan machine 100 from damage.

The buffering material 50 separates the ventilating fan machine 100 from the external packing carton 20 by a certain distance. As shown in FIG. 5, assuming that the buffering material between the ventilating fan machine 100 and the side surface 22 provided with the bending portion 40 has a thickness A, due to the separation of the buffering material, there is a space with a distance A between the ventilating fan machine 100 and the side surface 22 of the external packing carton 20 provided with the bending portion 40.

The thickness of the small packing carton 30 from a side thereof on an inner side of the external packing carton 20 to a side thereof on an outer side of the external packing carton 20 is B after the small packing carton 30 for packing the functional unit is put inside the opening 42 in the side surface 22 of the external packing carton 20. If the thickness B is equal to the thickness A, after the small packing carton 30 for packing the functional unit is inserted into the external packing carton 20 from the opening 42, a side of the small packing carton 30 for packing the functional unit on the inner side of the external packing carton 20 is adjacent to the ventilating fan machine 100, and a side of the small packing carton 30 for packing the functional unit on the outer side of the external packing carton 20 is flush with the side surface 22 of the external packing carton 20 and the shell of the external packing carton 20 will not become large. After adhesive tapes are adhered to the edges of the opening 42 on the outer side of the external packing carton 20, since the small packing carton 30 is clamped and fixed between the ventilating fan machine 100 and the adhesive tapes on the side surface 22 of the external packing carton 20, the small packing carton 30 will not project out of the side surface 22 of the external packing carton 20, and thus the volume of the external packing carton 20 for packing the ventilating fan machine 100 will not increase during transportation.

Figure 6:
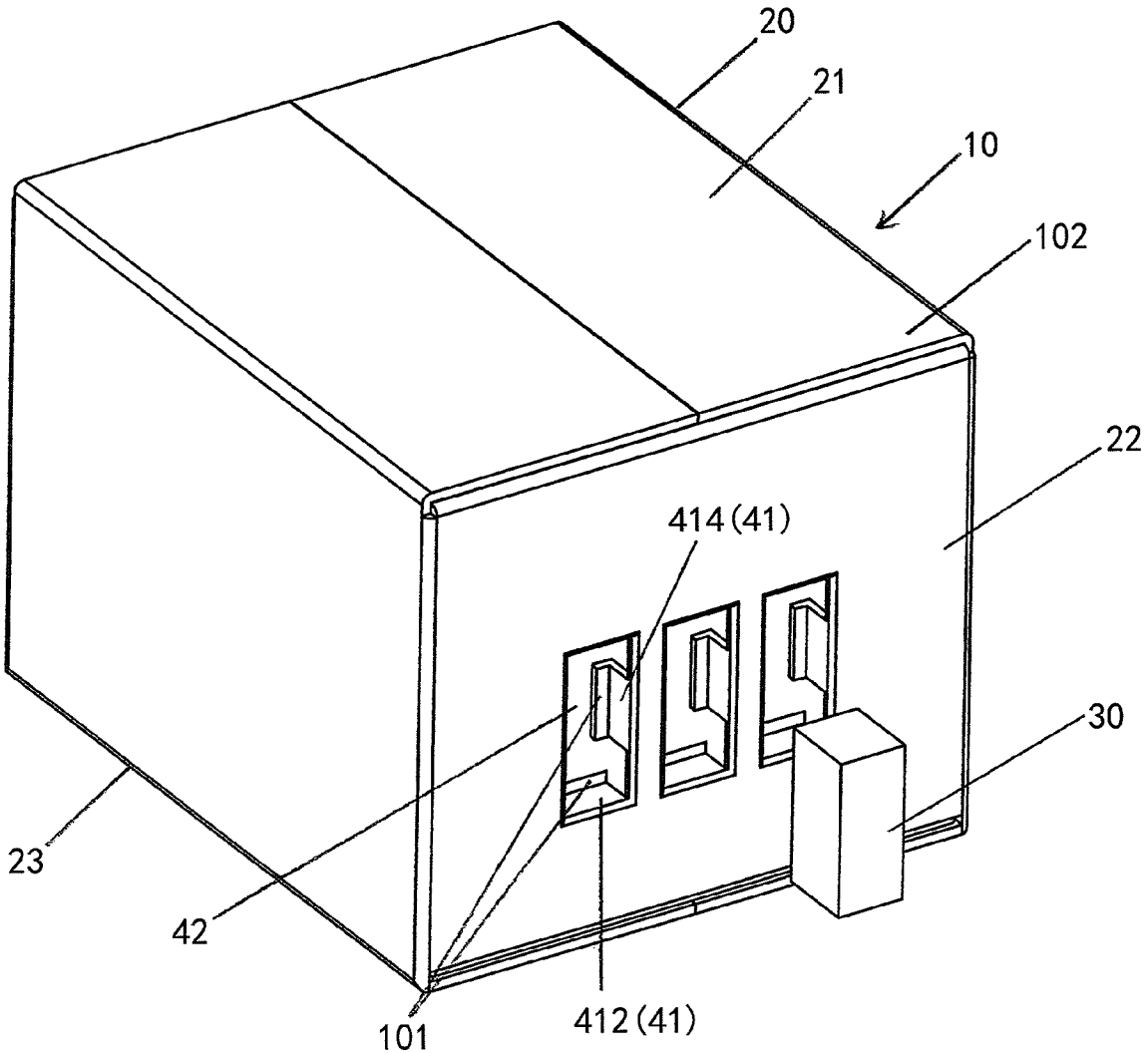
FIG. 6 is a schematic view of a packing structure according to a third embodiment of the present invention, in which a folding portion forms an opening.

FIG. 6 is a schematic view of a packing structure according to a third embodiment of the present invention, in which a folding portion forms an opening.

As shown in FIG. 6, the folding piece 41 is provided with a stopping part 101 on a side thereof opposite to a side surface 22 of the external packing carton 20. When the small packing carton 30 is inserted into the opening 42, the small packing carton 30 is stopped by the stopping part 101 and is not able to be inserted further. For example, even if there is a large distance between an outer side of the buffering material 50 (shown in FIG. 5) and an inner side of the external packing carton 20, in other words, even if there is a large distance between the ventilating fan machine 100 and the external packing carton 20 for inserting the small packing carton 30, the small packing carton 30 can be prevented from being inserted into the external packing carton 20 too much.

Therefore, the small packing carton 30 can be disposed in the opening 42 at a suitable depth so that the adhesive tapes can just adhere to the small packing carton 30 and the small packing carton 30 can be prevented from dropping off inside the external packing carton 20.

Further, as an example, the folding piece 41 is provided with a folding line and the stopping part 101 is formed by folding the folding piece 41 along the folding line.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A packing structure for receiving an article, comprising: the article;

an external packing carton, including a top surface, a bottom surface and side surfaces connected with the top surface and the bottom surface, the external packing carton defining an interior region for receiving the article, and one or more small packing cartons, wherein at least one said side surface of the external packing carton is provided with one or more folding portions, each folding portion including one or more folding pieces which are folded into the interior region of the external packing carton to form an opening in said side surface with a perimeter size corresponding to a perimeter size of a respective small packing carton of the one or more small packing cartons, wherein the interior region of the external packing carton is dimensioned to concurrently accommodate both the dimensions of the article and the folded one or more folding pieces.

2. The packing structure according to claim 1, wherein the one or more small packing cartons include two or more small packing cartons with the same size or different sizes.

3. The packing structure according to claim 1, wherein the one or more folding pieces of each opening include an upper piece, a lower piece, a left piece and a right piece combined with one another to form a rectangular shape.

4. The packing structure according to claim 3, wherein the upper piece, the lower piece, the left piece and the right piece each are rectangular; and each of the upper piece and the lower piece has left and right sides that are completely cut off or are formed as scores.

5. The packing structure according to claim 4, wherein at least one folding piece of the one or more folding pieces is provided with a stopping part on a side thereof opposite to a side surface of the external packing carton provided with the at least one folding piece.

6. The packing structure according to claim 3, wherein the upper piece has a lower side and the lower piece has an upper side that are completely cut off or formed as scores; and an intermediate side between the left piece and the right piece is completely cut off or formed as a score.

7. The packing structure according to claim 6, wherein at least one folding piece of the one or more folding pieces is provided with a stopping part on a side thereof opposite to a side surface of the external packing carton provided with the at least one folding piece.

8. The packing structure according to claim 3, wherein the upper piece, the lower piece, the left piece and the right piece are each triangular; and two sides, which are positioned between two adjacent triangular pieces, of each of the upper piece, the lower piece, the left piece and the right piece are completely cut off or formed as scores.

9. The packing structure according to claim 3, wherein at least one folding piece of the one or more folding pieces is provided with a stopping part on a side thereof opposite to a side surface of the external packing carton provided with the at least one folding piece.

10. The packing structure according to claim 1, wherein each folding piece of the one or more folding pieces has a plurality of sides and the sides of the folding piece, except one side thereof that is connected with the external packing carton, are completely cut off or formed as scores.

11. The packing structure according to claim 10, wherein at least one folding piece of the one or more folding pieces is provided with a stopping part on a side thereof opposite to a side surface of the external packing carton provided with the at least one folding piece.

12. The packing structure according to claim 1, wherein a buffering material is provided between the external packing carton and a packed article; and the buffering material between the packed article and a side surface of the external packing carton provided with the one or more folding portions has a thickness equal to a thickness of a thickest one of the one or more small packing cartons from a side thereof on an inner side of the external packing carton to a side thereof on an outer side of the external packing carton.

13. The packing structure according to claim 1, wherein at least one folding piece of the one or more folding pieces is provided with a stopping part on a side thereof opposite to a side surface of the external packing carton provided with the at least one folding piece.

14. The packing structure according to claim 1, wherein at least one folding piece of the one or more folding pieces is provided with a stopping part on a side thereof opposite to a side surface of the external packing carton provided with the at least one folding piece.

15. The packing structure according to claim 1, wherein the top surface and the bottom surface of the external packing carton each are provided with inner folding wings and outer folding wings, and one folding portion of the one or more folding portions is positioned on a side surface of the external packing carton so that the one folding portion does not interfere with opening the inner folding wings and the outer folding wings.

* * * * *